US006553730B1

(12) United States Patent
Mueller et al.

(10) Patent No.: US 6,553,730 B1
(45) Date of Patent: Apr. 29, 2003

(54) UTILITY HUB FOR POST AND BEAM FURNITURE SYSTEMS

(75) Inventors: Karl H. Mueller, East Grand Rapids, MI (US); Mark A. Zeh, Mountain View, CA (US); James R. Yurchenco, Palo Alto, CA (US); Todd A. Pelman, San Francisco, CA (US); Steve L. Atkins, Palo Alto, CA (US); Thomas B. Eich, Palo Alto, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/094,118

(22) Filed: Mar. 8, 2002

(51) Int. Cl.[7] ..... E06B 1/04
(52) U.S. Cl. ..... 52/220.5; 439/654
(58) Field of Search ..... 52/220.7, 220.5, 52/36.1, 239, 242, 481, 220.1; 160/351; 359/118; 439/654

(56) References Cited

U.S. PATENT DOCUMENTS

| | | | | |
|---|---|---|---|---|
| 4,408,543 A | | 10/1983 | Griffin | |
| 4,625,633 A | | 12/1986 | Martin | |
| 5,007,222 A | * | 4/1991 | Raymond | 52/586.1 |
| 5,044,135 A | | 9/1991 | Kroon et al. | 52/239 |
| 5,065,832 A | | 11/1991 | Mark | 108/60 |
| 5,438,937 A | | 8/1995 | Ball et al. | |
| 5,526,619 A | | 6/1996 | Vagedes | 52/220.1 |
| 5,655,822 A | | 8/1997 | Roberts et al. | 312/194 |
| 5,675,949 A | | 10/1997 | Forslund et al. | |
| 5,697,193 A | | 12/1997 | Forslund, III et al. | |
| 5,715,760 A | | 2/1998 | Frascaroli et al. | 108/50 |
| 5,718,179 A | | 2/1998 | Johnson et al. | 108/153 |
| 5,768,840 A | | 6/1998 | Feldpausch et al. | 52/239 |
| 5,802,988 A | | 9/1998 | Shields | 108/147 |
| D408,355 S | | 4/1999 | Welsh et al. | |
| 5,931,528 A | | 8/1999 | Shields | 297/174 |
| 6,042,426 A | | 3/2000 | Byrne | 439/654 |
| 6,081,356 A | | 6/2000 | Branc et al. | 359/118 |
| 6,223,478 B1 | * | 5/2001 | Wheeler | 52/36.1 |
| 6,374,547 B1 | * | 4/2002 | Baloga et al. | 52/36.1 |

FOREIGN PATENT DOCUMENTS

| | | |
|---|---|---|
| WO | 0021412 | 4/2000 |

* cited by examiner

*Primary Examiner*—Ramon O. Ramirez
(74) *Attorney, Agent, or Firm*—Price, Heneveld, Cooper, DeWitt & Litton

(57) ABSTRACT

A utility hub for post and beam furniture systems includes a housing defining an interior space, having a radially disposed notch adapted to laterally receive a vertically extending post therein, and including at least first aperture adapted to allow access to an electrical power receptacle and at least one second aperture adapted to allow access to a communication receptacle. The utility hub also includes a divider member located within the interior space of the housing and substantially dividing the interior space into a first section that includes the first aperture, and a second section that includes the second aperture, and a housing insert located within the notch of the housing, operably connected to the housing, and cooperating with the housing to define a central aperture adapted to receive the post therein.

38 Claims, 8 Drawing Sheets

UTILITY HUB FOR POST AND BEAM FURNITURE SYSTEMS

BACKGROUND OF THE INVENTION

The present invention relates to a utility hub, and in particular to a utility hub for use in post and beam furniture systems and the like.

Portable partition systems for office space and other similar settings are known in the art. Individual partition panels are interconnected in different configurations to form separate offices, workstations, and/or work settings. The particular panels are extremely durable and can be readily disassembled and reassembled into alternative configurations to meet the ever-changing needs of the user. Examples of such partition systems are provided in U.S. Pat. Nos. 3,822,146; 3,831,330; and 4,144,920, which are owned by Steelcase Development Corporation, the assignee of the present invention.

Post and beam furniture systems have also been developed to divide open office plans three-dimensionally into individual workstations and/or work settings. Examples of such furniture systems are provided in U.S. Pat. Nos. 6,003,275; 5,950,371; and 5,899,025, which are also owned by Steelcase Development Corporation, the assignee of the present invention.

Utility hubs are used in a wide variety of applications, such as within table and chair assemblies. These utility hubs typically include electrical receptacles and/or data receptacles located therein, thereby allowing convenient access to the same. Heretofore, these utility hubs have failed to provide adequate insulation between the electrical receptacles and data receptacles, thereby allowing interference in the signals transmitted therethrough. Further, these utility hubs have been incompatible for use within post and beam furniture systems and the like.

As a result, there is a need for a utility hub offering adequate insulation and division between the power receptacles and data receptacles associated therewith, as well as a need for a utility hub compatible for use within and connection to a post and beam furniture system.

SUMMARY OF THE INVENTION

One aspect of the present invention is to provide a utility hub for use in a post and beam furniture system that includes a housing defining an interior space, having a radially disposed notch adapted to laterally receive a vertically extending post therein, and including at least one first aperture adapted to allow access to an electrical power receptacle and at least one second aperture adapted to allow access to a communication receptacle. The utility hub also includes a divider member located within the interior space of the housing and substantially dividing the interior space into a first section that includes the first aperture, and a second section that includes the second aperture. The utility hub further includes a housing insert located within the notch of the housing, operably connected to the housing, and cooperating with the housing to define a central aperture adapted to receive the post therein.

Another aspect of the present invention is to provide a utility hub assembly for use in a post and beam furniture system that includes a housing defining an interior space, having a radially disposed notch adapted to laterally receive a vertically extending post therein, and including at least one first aperture adapted to allow access to an electrical power receptacle and at least one second aperture adapted to allow access to a communication receptacle. The utility hub assembly also includes a divider member located within the interior space of the housing and substantially dividing the interior space into a first section that includes the first aperture, and a second section that includes the second aperture, and a housing insert located within the notch of the housing, operably connected to the housing, and cooperating with the housing to define a central aperture adapted to receive the post therein. The utility hub assembly further includes a utility tube defining a central passage and operably connected with a select one of the housing and the housing insert such that the central passage of the utility tube is in communication with the interior space of the housing.

The present inventive utility hub and associated utility hub assembly provides a utility hub convenient for use and attachment within post and beam furniture systems and the like, can be easily and quickly assembled, is efficient in use, and is particularly well adapted for the assembly to and use within a post and beam furniture system.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
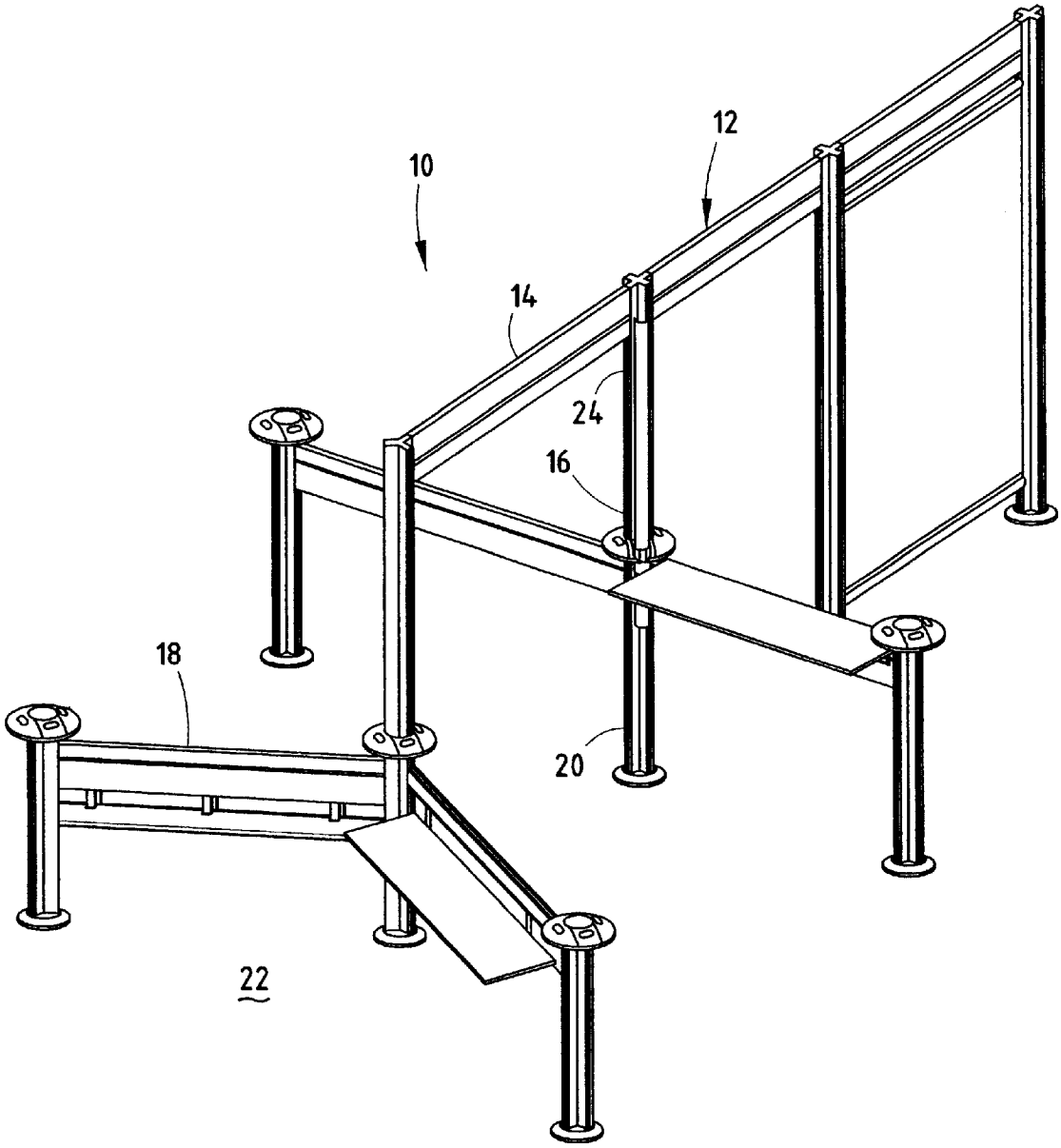
FIG. 1 is a perspective view of a post and beam furniture system including a utility hub embodying the present invention.
Figure 4:
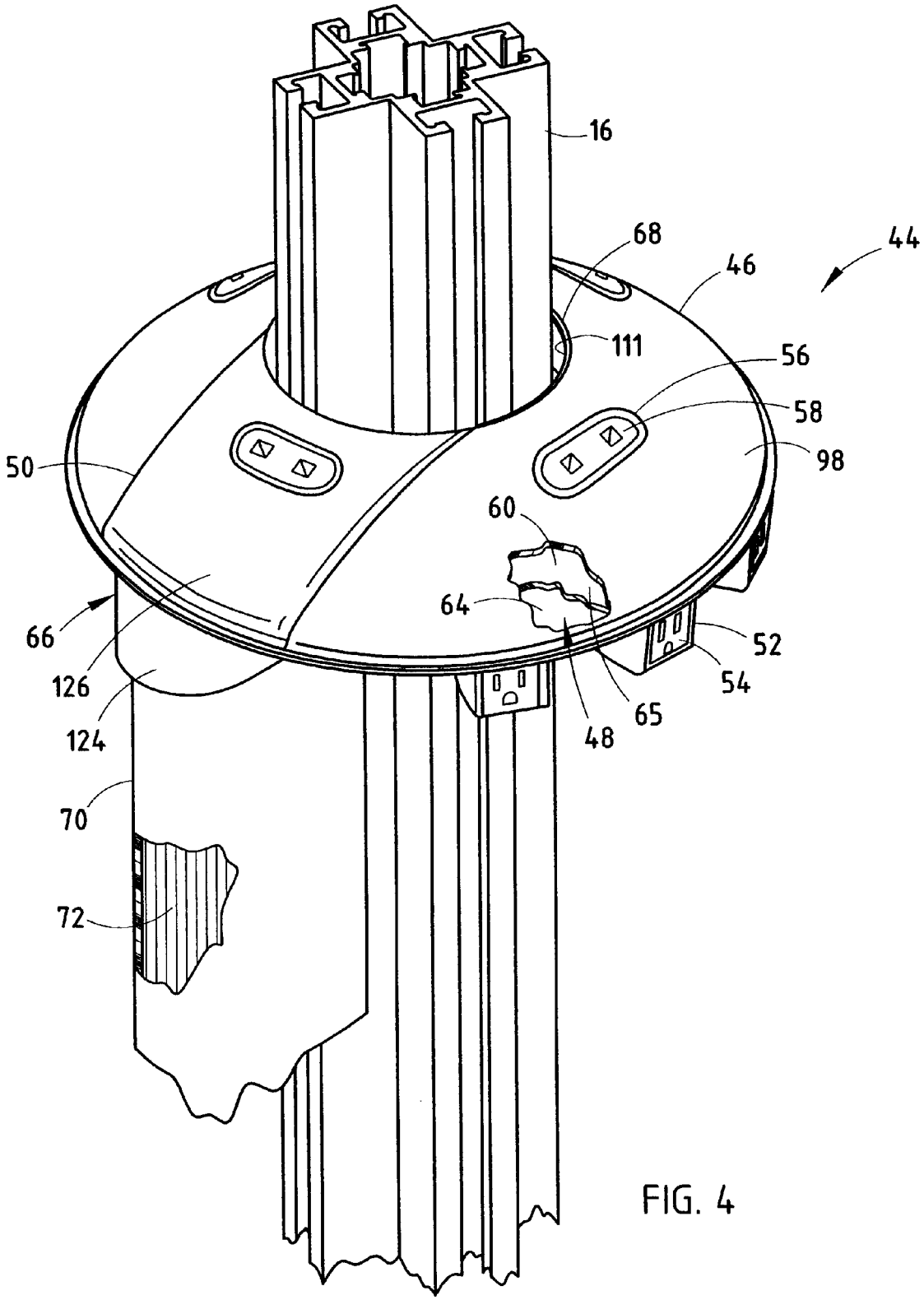
FIG. 4 is a perspective view of the utility hub assembled with a utility tube and a vertically extending post.

For purposes of description herein, the terms "upper," "lower," "right," "left," "rear," "front," "vertical," "horizontal," and derivatives thereof shall relate to the invention as oriented in FIGS. 1 and 4. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a post and beam furniture system embodying the present invention. The prefabricated furniture system 10 is of the type that is designed for use in open building plans and the like, and includes a freestanding portable partition system 12 that includes a plurality of horizontally-extending overhead beams 14 interconnected to define an overhead framework, a plurality of vertically-extending posts or support columns 16, and a plurality of horizontally-extending mid-height beams 18. Posts 16 each includes a lower end 20 abuttingly supported on a building floor surface 22, and an upper end 24 connected with the overhead framework as formed by overhead beams 14.

Figure 2:
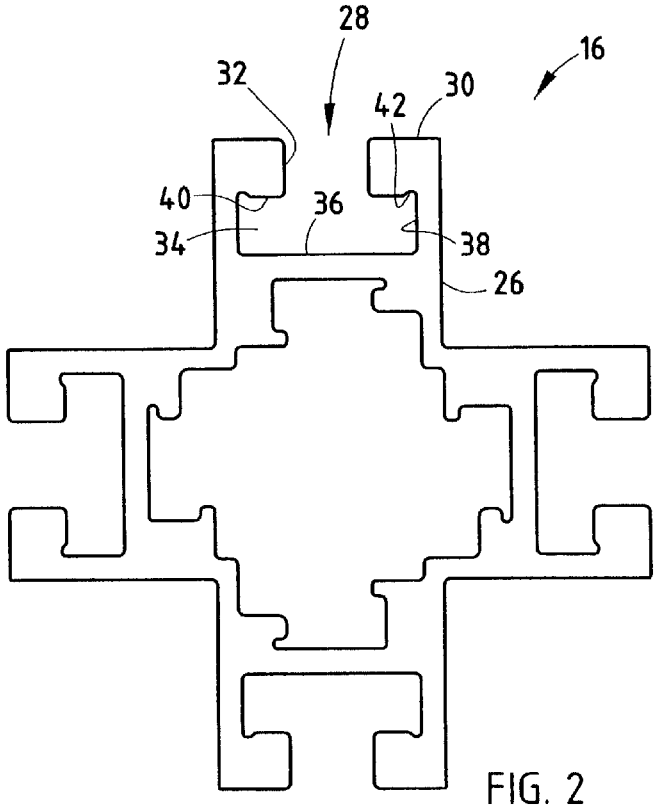
FIG. 2 is a perspective view of a vertically extending post of the post and beam furniture system, wherein the post has an X-shaped cross-sectional configuration.
Figure 3:
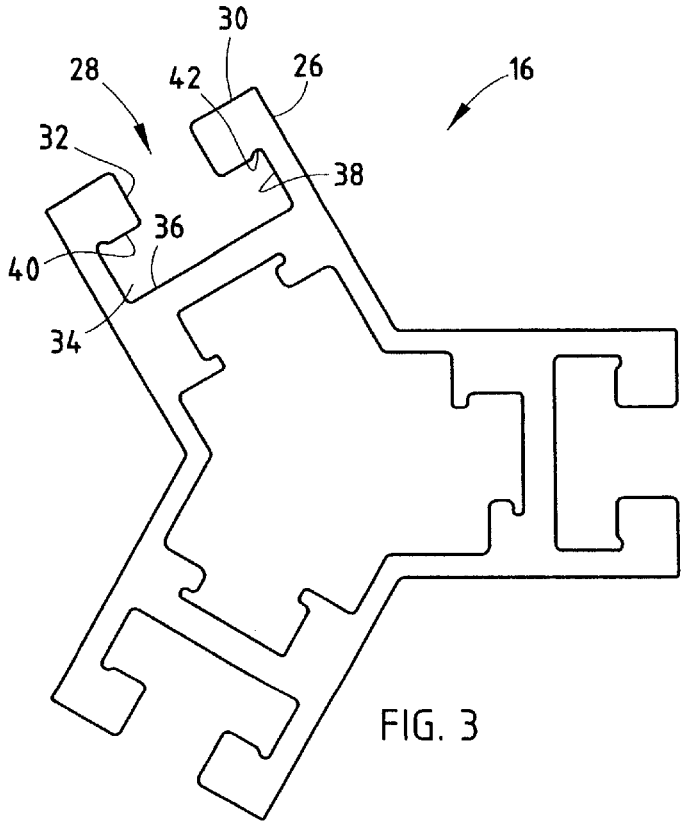
FIG. 3 is a perspective view of a vertically extending post of the post and beam furniture system, wherein the post has a Y-shaped cross-sectional configuration.

The posts 16 (FIGS. 2 and 3) associated with the illustrated post and beam furniture system 10 are provided in T, X, L and Y configurations, wherein each projecting leg or flange 26 of each post 16 includes a T-shaped channel 28. For example, as illustrated in FIG. 2, a post 16 having an X-shaped configuration incorporates four projecting legs or flanges 26 which are disposed in a mutually-perpendicular relationship to define a cruciform shape. Each end face 30 of each of the flanges 26 incorporates a T-shaped channel 28 along the entire length thereof. A post 16 having a Y-shaped configuration, as illustrated in FIG. 3, incorporates three projecting legs or flanges 26 which are disposed in a triangularly-shaped relationship. Similar to the X-shaped posts 16 of FIG. 2, each face 30 of each of the flanges 26 of Y-shaped post 16 incorporates a T-shaped channel 28 along the entire length thereof. As best illustrated in FIGS. 2 and 3, each of the T-shaped channels 28 of posts 16 includes a narrowed neck portion 32 providing access to an enlarged interior portion 34 partially defined by an interior rear wall 36, an interior side wall 38 and an interior channel wall 40. Each interior channel wall 40 includes a longitudinally-extending, distally located groove 42. Each channel 28 has a T-shaped lateral cross-sectional configuration which is adapted to detachable receive and capture mating fasteners therein, as discussed below.

The reference numeral 44 (FIG. 4) generally designates a utility hub assembly embodying the present invention. In the illustrated example, the utility hub assembly 44 includes a housing 46 defining an interior space 48, having a U-shaped radially disposed notch 50 adapted to laterally receive the vertically extending post 16 therein, and including a plurality of electrical power receptacle receiving apertures 52 that allow access to a plurality of electrical power receptacles 54 located within interior space 48, and a plurality of communication/data receptacle receiving apertures 56 allowing access to a plurality of communication/data receptacles 58 located within interior space 48. The utility hub assembly 44 also includes a divider member 60 (FIG. 5) located within interior space 48 of housing 46 and dividing interior space 48 into a first section 64 that includes apertures 52, and a second section 65 that includes apertures 56. The utility hub assembly 44 also includes a housing insert 66 located within notch 50 of housing 46, operably connected to housing 46, and cooperating with housing 46 to define a central aperture 68 that receives post 16 therein. Utility hub assembly 44 further includes a utility tube 70 defining a central passage 72 and operably connected with housing 46 such that passage 72 of utility tube 70 is in communication with interior space 48 of housing 46 as described below.

Figure 6:
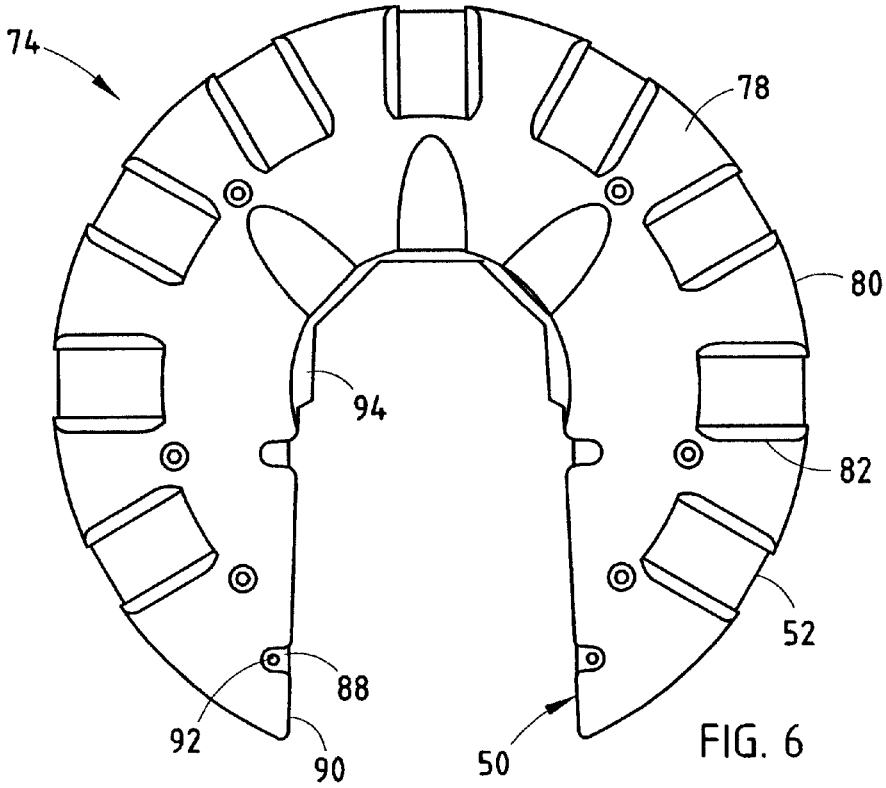
FIG. 6 is a top plan view of a base of the utility hub.
Figure 7:
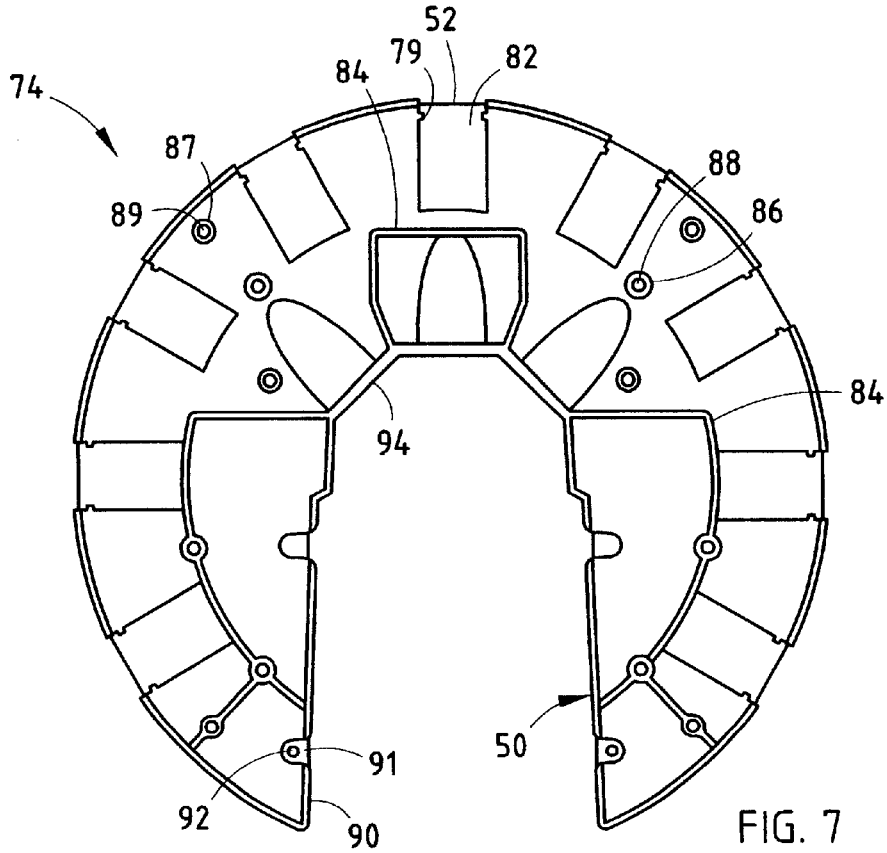
FIG. 7 is a bottom plan view of the base of the utility hub.
Figure 8:
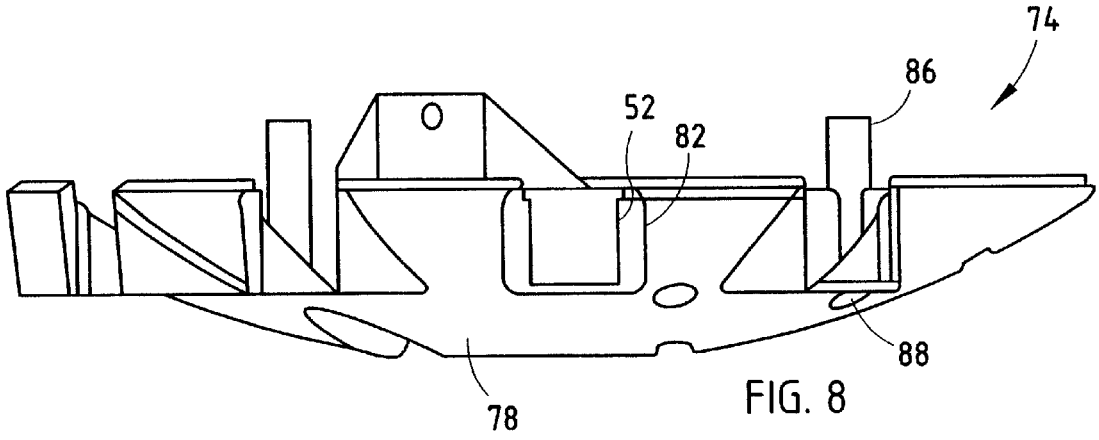
FIG. 8 is a side perspective view of the base of the utility tube.

The housing 46 includes a bowl-shaped base 74 and a bowl-shaped cover 76 that cooperate to provide housing 46 with a saucer-like shape. Base 74 (FIGS. 6–8) includes an arcuately-shaped bottom surface 78, a radially edge 80, and the U-shaped notch 50 extending inwardly from radial edge 80. Apertures 52 are spaced about the periphery of edge 80 and are each defined by a rectangularly-shaped sleeve 82 extending radially outwardly from aperture 68 and downwardly from surface 78. Each sleeve 82 includes a pair of inwardly-extending retainer walls 79 that secure receptacles 54 therein. Base 74 also includes a plurality of upwardly-extending structural integrity walls 84 that structurally reinforce base 74, a plurality of upwardly-extending studs 86 each including apertures 88 extending therein that receive mounting hardware therein for connecting cover 76 to base 74, and a plurality of upwardly-extending studs 87 each including aperture 89 extending therein that receive mounting hardware therein for connecting divider member 74 to housing 46, as described below. Base 74 also includes two pairs of studs 91 extending inwardly from an inner wall 90 of notch 50, each including an aperture 92 extending therein that receive mechanical fasteners therein for connecting housing insert 66 to housing 46, as described below. Inner wall 90 of notch 50 includes a plurality of abutment walls 94 defining a semi-circular, octagon-shape. Walls 90 include a plurality of apertures 96 (FIG. 5) extending therethrough and adapted to receive mechanical fasteners therein for connecting housing 46 with post 16 as described below.

Figure 5:
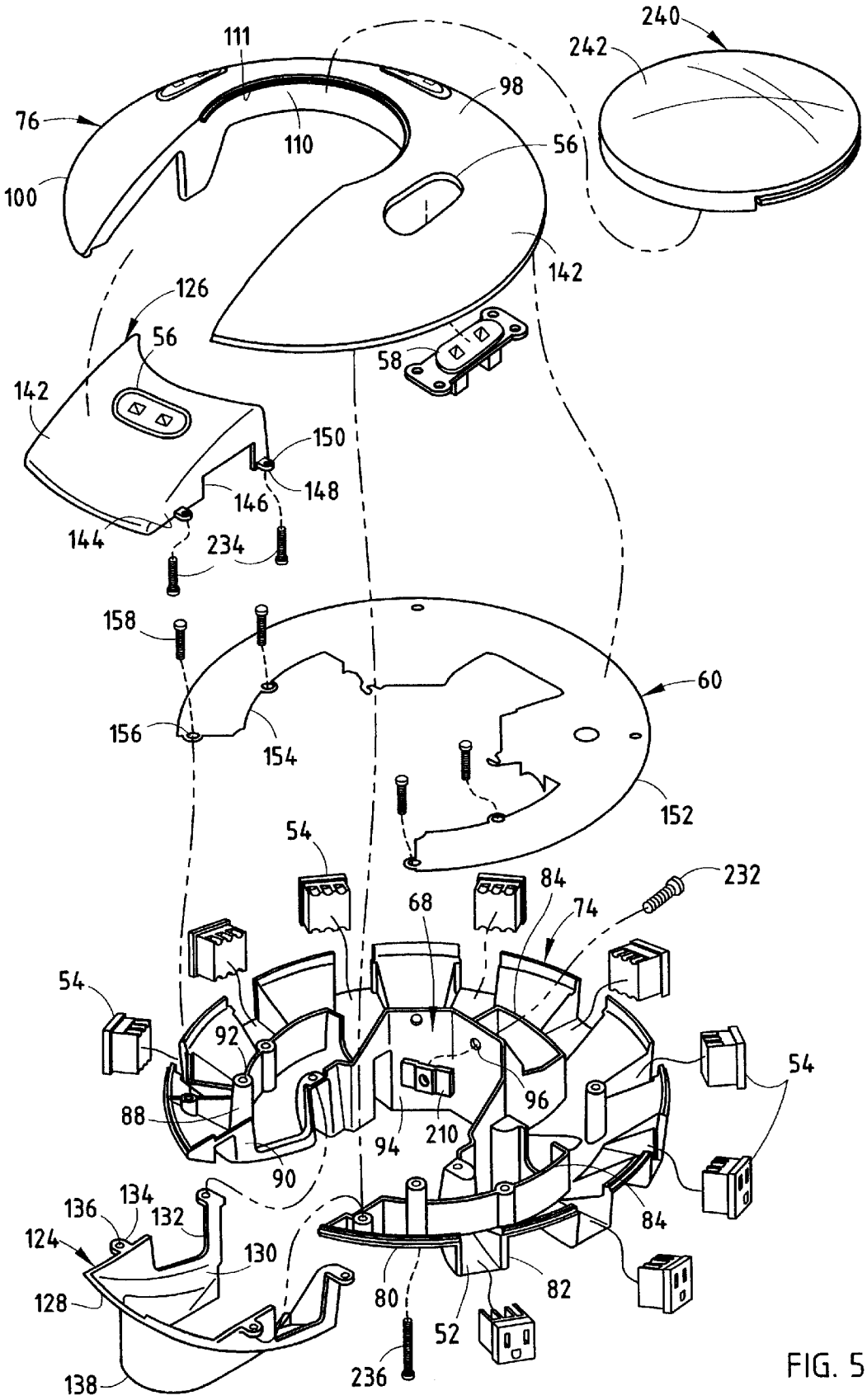
FIG. 5 is an exploded perspective view of the utility hub.
Figure 9:
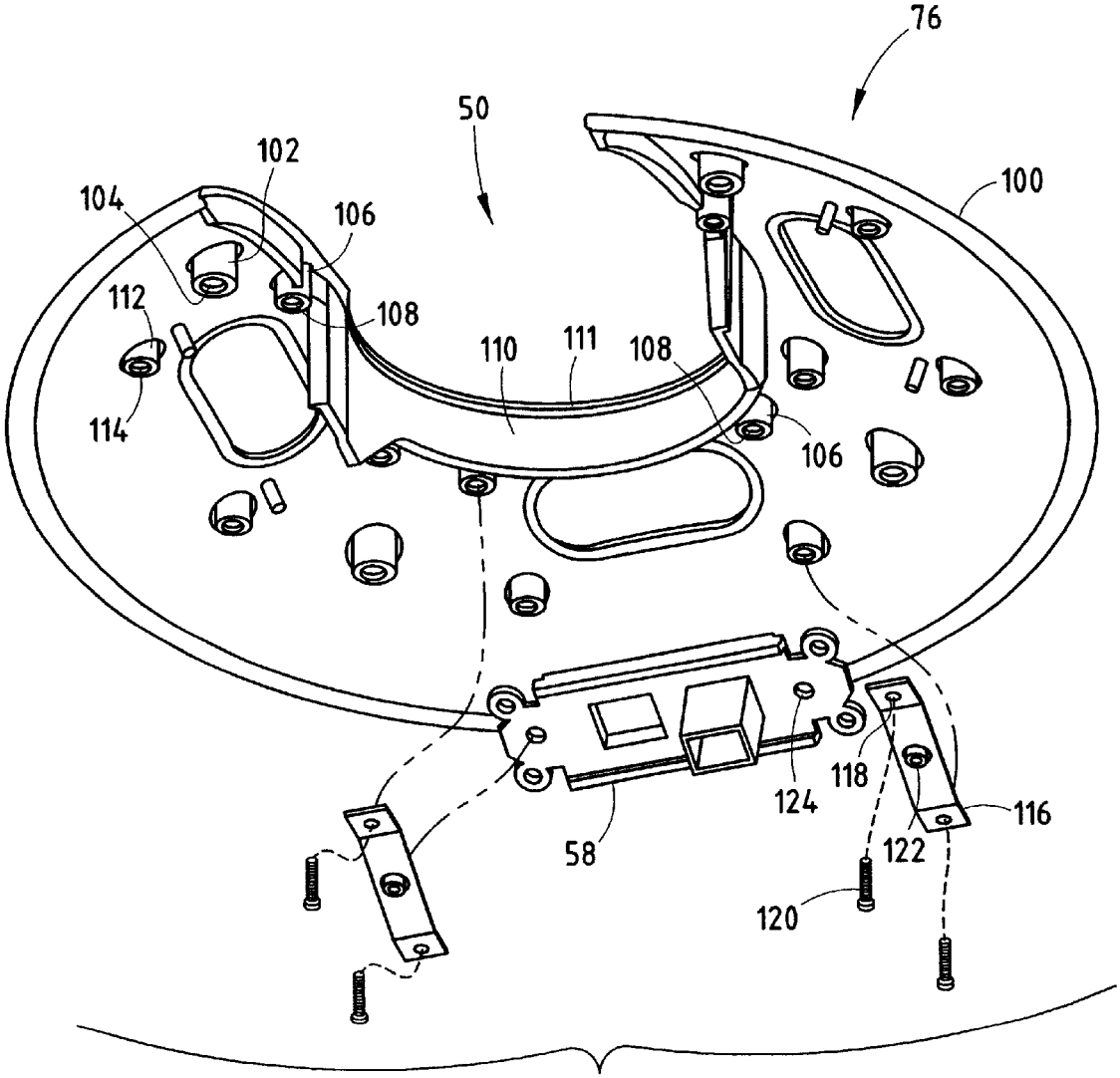
FIG. 9 is an enlarged perspective view of a first portion of a housing insert.

As best illustrated in FIGS. 5 and 9, the cover 76 of housing 46 includes a arcuately-shaped top surface 98, a radially edge 100, and the U-shaped notch 50 extending inwardly from edge 100. Apertures 56 are circumferentially spaced about cover 76 and extend therethrough. Cover 76 includes a plurality of downwardly extending studs 102 each including an aperture 104 extending therein and concentrically located with apertures 88 of base 74 when base 74 and cover 76 are connected. Cover 76 also includes two pairs of downwardly extending studs 106 having mechanical receiving apertures 108 extending therein that receive mechanical fasteners therein for connecting housing insert 66 to housing 46 as described below. A centrally-located U-shaped downwardly extending collar 110 receives walls 94 of base 74 therein as described below. Collar 110 includes an inwardly extending lip 111. Cover 76 further includes a plurality of downwardly extending studs 112 having apertures 114 extending therein. Each communication/data receptacle 58 is operably connected to cover 76 by a pair of retainer plates 116 each including a pair of distally located apertures 118 extending therethrough and which are co-located with apertures 114 of studs 112 of cover 76 upon assembly. A plurality of mechanical fasteners such as screws 120 extend through apertures 118 of each retainer plate 116 and are threadably received within apertures 114 of studs 112, thereby retaining a tab 122 centrally located within each retainer plate 116 within a pair of apertures 124 juxtaposed along the length of each receptacle 54 and securing receptacles 54 between retainer plates 116 and cover 76.

The housing insert 66 includes a lower portion 124 (FIGS. 5 and 9) and upper portion 126. Lower portion 124 of housing insert 66 is defined by an arcuately shaped bottom wall 128 and a pair of perpendicularly-extending side walls 130 each having a partial window 132 extending therethrough. Lower portion 124 of housing insert 66 also includes two pairs of tabs 134 extending outwardly and perpendicular to side walls 130 and each including an aperture 136 extending therethrough. Lower portion 124 is configured such that apertures 136 of tabs 134 are concentrically located with apertures 92 of studs 91 of base 74 after assembly of utility hub assembly 44 as discussed below. Lower portion 124 of housing insert 66 further includes a U-shaped collar 138 extending downwardly from bottom wall 128 and defining an aperture 140. Upper portion 126 of housing insert 66 includes an arcuate top wall 142 and a pair of side walls 144 extending perpendicular to top wall 142 and each including a partial window 146 therein that cooperates with partial window 132 of lower portion 124 to define a full window. Upper portion 126 also includes two pairs of tabs 148 extending outwardly and perpendicularly from side walls 144 and each including an aperture 150 extending therethrough that receive mechanical fasteners therein for connecting upper portion 126 to housing 46. Top wall 128 includes an aperture 56 that provides access to a communication/data receptacle 58 mounted to an underside of top wall 142 similar to as described above with respect to cover 76.

Figure 10:
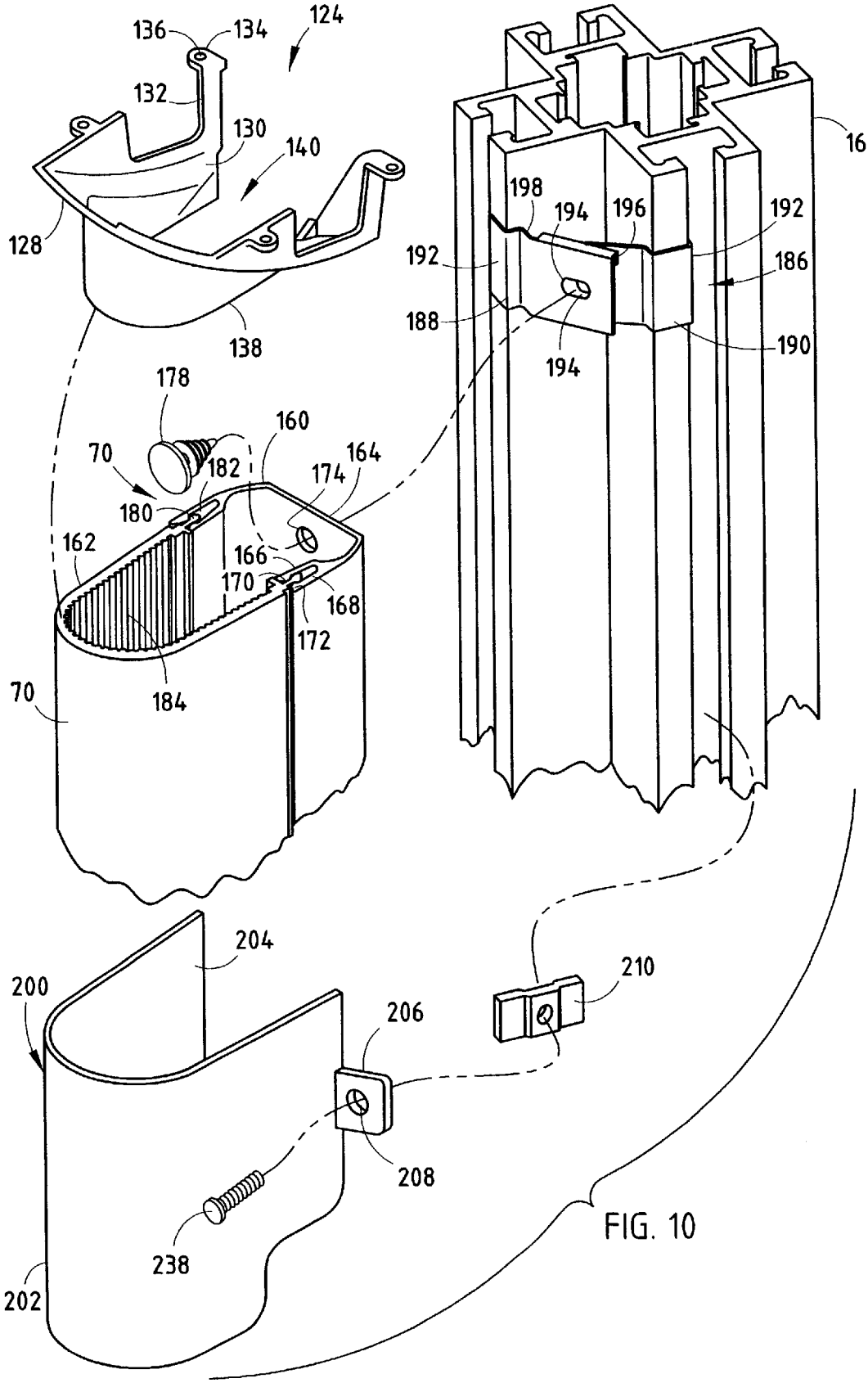
FIG. 10 is an exploded perspective view of the utility tube, a utility tube retainer, and a plurality of fasteners for connecting the utility tube to the utility post.

The divider member 60 (FIG. 5) is substantially planar and includes a semi-circular outer edge 152 and an inner edge 154 having a shape that is substantially similar to the plan configuration of structural support walls 84. A plurality of apertures 156 extend through divider 60 and are adapted to receive mechanical fasteners such as screws 158 therein for connecting divider 60 to housing 46. utility tube 70 (FIG. 10) includes an elongated U-shaped first portion 160 and an elongated U-shaped second portion 162 that is snappably engaged with first portion 160. First portion 160 includes a planar base portion 164 and two pairs of outwardly-extending fingers each including an inner finger 166 and an outer finger 168. Inner finger 166 includes a longitudinally-extending tooth or barb 170, while finger 168 includes a longitudinally-extending engagement tooth or barb 172 that cooperates with tooth 170 to retain second portion 162 of utility tube 70 as inner finger 166 and outer finger 168 are each flexibly resilient. Base portion 164 includes a plurality of apertures adapted to receive mechanical fasteners such as Christmas-tree fasteners 178 therein. Alternatively, fasteners 178 may be replaced by screws that are threadably received within aperture 194 of second bracket 190. Second portion 162 of tube 170 includes a pair of tabs 180 each including an enlarged head 182 and extending longitudinally along terminating edges of the U-shaped second portion 162. Second portion 162 is provided with a ribbed interior surface 184, and is preferably constructed of an extruded translucent plastic, although other suitable materials may be utilized.

The utility hub assembly 44 further includes a bracket assembly 186 that includes a first bracket 188 and a second bracket 190. Brackets 188 and 190 each include a C-shaped end 192 mountable within channel 28 of post 16, and a centrally located aperture 194 extending therethrough. First bracket 188 includes a downwardly opening hook portion 194 extending inwardly from an upper edge 198 thereof.

The utility hub assembly 44 further includes a retainer 200 (FIG. 4) that includes a U-shaped wall 202 having a collar portion 204 that receives an end of utility tube 70. Retainer 200 also includes a pair of flanges 206 extending outwardly from wall 202 and each including an aperture 208. The retainer 200 is operably connected to post 16 via a pair of T-nuts 210 as described below.

Figure 11:
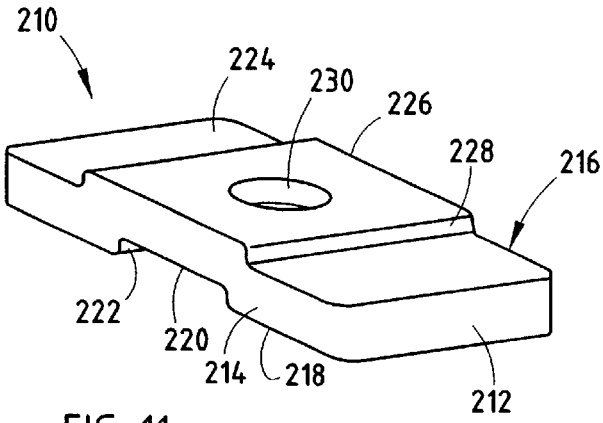
FIG. 11 is a bottom plan view of a cover of the utility hub.
Figure 12:
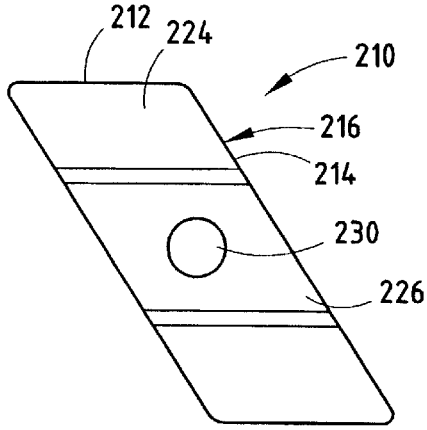
FIG. 12 is an exploded perspective view of a second portion of the housing insert.
Figure 13:
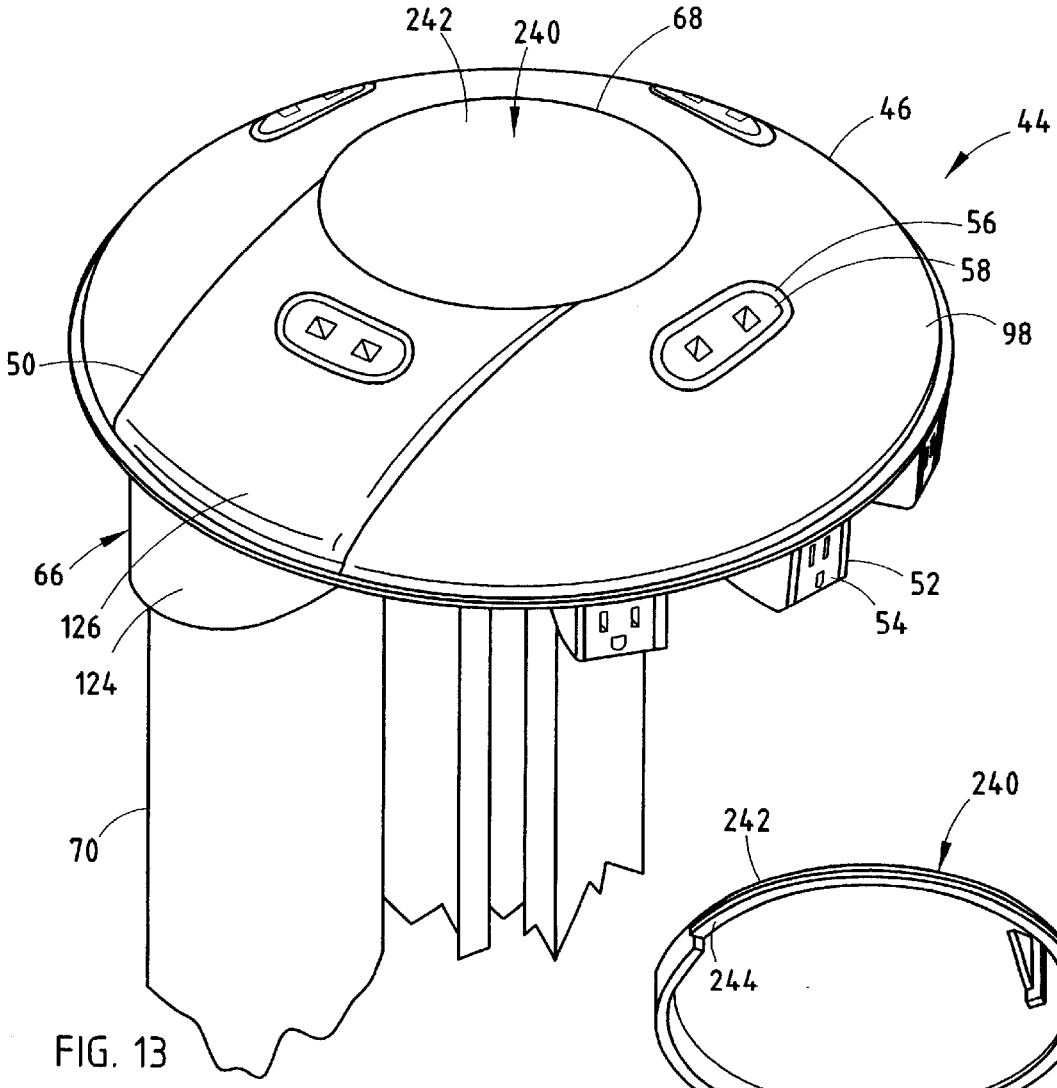
FIG. 13 is a perspective view of the utility tube including an end cap.
Figure 14:
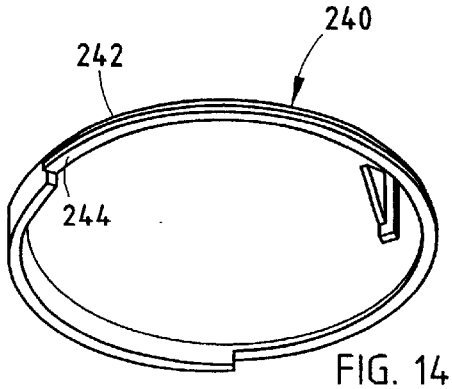
FIG. 14 is a bottom perspective view of the end cap.

The utility hub 46 and retainer 200 are each operably connected to post 16 via a plurality of T-nuts 210 (FIGS. 11 and 12). Each T-nut 210 includes a pair of substantially parallel end walls 212 and a pair of substantially parallel side walls 214 that cooperate to define a substantially parallelogram-shaped body 216 that is adapted to be received within inner portion 34 of channel 28 of post 16. Each T-nut 210 also includes a first surface 218 having a recessed center portion 220 defined by a pair of inwardly-extending walls 222 extending substantially parallel to end walls 212, and a second surface 224 juxtaposed from first surface 218 and having a raised center portion 226 defined by a pair of outwardly-extending walls 228 that extend substantially parallel to end walls 212. Each T-nut 210 further includes a threaded aperture 230 extending between first surface 218 and second surface 224.

In assembly, receptacles 54 are placed within sleeves 82 of base 74 and attached to associated electrical wiring (not shown). Base 74 is placed about post 16 by sliding base 74 laterally and post 16 though notch 50 thereof. Base 74 is operably connected to post 16 via a plurality of T-nuts 210 located within interior portion 34 of the associated channels 28 and connected to base 74 by a plurality of mechanical fasteners such as bolts 232 that extend through apertures 96 of wall 94 and are threadably received within aperture 230 of each T-nut 210. Each bolt 232 is tightened until end wall 212 of each T-nut 210 abuts interior side walls 38 of the associated channel 28, thereby forcing second surface 224 of each T-nut 210 to frictionally engage interior channel wall 40 of the associated channel 28 and raised center portion 226 of each T-nut to enter 32 of the associated channel 28. Divider member 60 operably connected with base 74 by screws 158 that extend through apertures 156 of divider member 60 and are threadably received within apertures 89 of studs 87. A plurality of mechanical fasteners similar to screws 158, as described above, fasten first portion 124 of housing insert 66 to base 74 by extending the screws through apertures 136 of tabs 135 of first portion 124 and threading the screws into apertures 92 of studs 88. Receptacles 58 are operably connected to cover 76 and second portion 126 of housing insert 66 as describe above and attached to associated data communication lines (not shown). Cover 76 is placed about post 16 by sliding cover 76 laterally and post 16 though notch 50 thereof. Second portion 126 of housing insert 66 is then operably connected to cover 76 by screws 234 that extend through apertures 150 of tabs 148 and are threadably received within apertures 108 of studs 106. Cover 76 is then connected to base 74 by bolts or screws 236 that extend upwardly through apertures 88 of studs 86 and are threadably received within apertures 104 of studs 102. Utility tube 70 is operably connected with utility hub assembly 44 by placing and end of utility tube 70 within collar 138 of first portion 124 of housing insert 66. Utility tube 70 is connected with post 16 via bracket assembly 186 mounting brackets 188 and 190 into channels 28 of post 16 and connecting hook 196 of second bracket 190 to first bracket 188. Fasteners 178 are then utilized to connect utility tube 70 to each bracket assembly 186. A second end of utility tube 70 is placed within collar 204 of retainer 200. Retainer 200 is operably connected to post 16 by a pair of T-nuts 210 located within interior portion 34 of associated channels 28 and that connected to retainer 200 by 238 that extend through apertures 208 and are threadably received within apertures 230 of each T-nut 210. It should be noted that while in the present example utility tube 70 extends downwardly from housing 46, utility hub assembly 44 may be reconfigured such that utility tube 70 extends upwardly from housing 46 by connecting first portion 125 of housing insert 66 with cover 76 and second portion 126 of housing insert 66 with base 74.

The utility hub assembly 44 alternatively includes a cap 240 located within aperture 68. Cap 240 is utilized within assembly 44 when assembly 44 is connected to a partial height post 16 as best illustrated in FIG. 1. Cap 240 includes an arcuately-shaped upper surface 242 and a radial wall 244 extending downwardly therefrom. Wall 24 includes an outwardly extending lip 244. In assembly, cap 240 is located within aperture 68 such that lip 111 of cover 76 engages lip 244 of cap 240, thereby holding cap 240 within aperture 68.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A utility hub for use in a post and beam furniture system, comprising:

a housing defining an interior space, having a radially disposed notch adapted to laterally receive a vertically extending post therein, and including at least one first aperture adapted to allow access to an electrical power receptacle and at least one second aperture adapted to allow access to a communication receptacle;

a divider member located within the interior space of the housing and substantially dividing the interior space into a first section that includes the first aperture, and a second section that includes the second aperture; and a housing insert located within the notch of the housing, operably connected to the housing, and cooperating with the housing to define a central aperture adapted to receive the post therein.

2. The utility hub of claim 1, wherein the housing insert partially defines the interior space of the housing.

3. The utility hub of claim 2, wherein the housing includes a base and a cover operably connected to the base, and wherein the base and the cover cooperate to define the interior space.

4. The utility hub of claim 3, wherein housing and the housing insert cooperate to form a disk-shape.

5. The utility hub of claim 4, wherein the at least one first aperture includes a plurality of first apertures spaced circumferentially about the base of the housing.

6. The utility hub of claim 5, wherein the at least one second aperture includes a plurality of second apertures space circumferentially about the cover of the housing.

7. The utility hub of claim 6, wherein each of the first apertures are defined a plurality of corresponding sleeves that extend downwardly from an outer surface of the housing.

8. The utility hub of claim 7, wherein the central aperture includes a plurality of planar walls that cooperate to form a substantially octagon shape.

9. The utility hub of claim 8, wherein the housing insert includes an aperture adapted to receive wiring therethrough.

10. The utility hub of claim 9, wherein the housing inserting includes an upper portion and a lower portion that operably connects to the upper portion.

11. The utility hub of claim 10, wherein the lower portion of the housing insert includes the aperture adapted to receive wiring therethrough.

12. The utility hub of claim 9, wherein the housing insert includes an outwardly extending collar extending about the aperture and adapted to receive a utility tube therein.

13. The utility hub of claim 1, wherein the housing includes a base and a cover operably connected to the base, and wherein the base and the cover cooperate to define the interior space.

14. The utility hub of claim 1, wherein housing and the housing insert cooperate to form a disk-shape.

15. The utility hub of claim 1, wherein the at least one first aperture includes a plurality of first apertures spaced circumferentially about the housing.

16. The utility hub of claim 15, wherein each of the first apertures are defined a plurality of corresponding sleeves that extend downwardly from an outer surface of the housing.

17. The utility hub of claim 1, wherein the at least one second aperture includes a plurality of second apertures space circumferentially about the housing.

18. The utility hub of claim 1, wherein the central aperture includes a plurality of vertically oriented planar walls that cooperate to form a substantially octagon shape.

19. The utility hub of claim 1, wherein the housing insert includes an aperture adapted to receive wiring therethrough.

20. The utility hub of claim 1, wherein the housing inserting includes an upper portion and a lower portion that operably connects to the upper portion.

21. The utility hub of claim 1, wherein the housing insert includes the aperture adapted to receive wiring therethrough.

22. The utility hub of claim 21, wherein the housing insert includes an outwardly extending collar extending about the aperture and adapted to receive a utility tube therein.

23. A utility hub assembly for use in a post and beam furniture system, comprising:

a housing defining an interior space, having a radially disposed notch adapted to laterally receive a vertically extending post therein, and including at least one first aperture adapted to allow access to an electrical power receptacle and at least one second aperture adapted to allow access to a communication receptacle;

a divider member located within the interior space of the housing and substantially dividing the interior space into a first section that includes the first aperture, and a second section that includes the second aperture;

a housing insert located within the notch of the housing, operably connected to the housing, and cooperating with the housing to define a central aperture adapted to receive the post therein; and a utility tube defining a central passage and operably connected with a select one of the housing and the housing insert such that the central passage of the utility tube is in communication with the interior space of the housing.

24. The utility hub of claim 22, wherein the housing insert partially defines the interior space of the housing.

25. The utility hub of claim 24, wherein the housing insert includes an aperture in communication with the passage of the utility tube.

26. The utility hub of claim 25, wherein the housing insert includes a first collar that receives a first end of the utility tube therein.

27. The utility hub of claim 26, wherein the first collar extends upwardly from the housing insert.

28. The utility hub of claim 27, further including:

a retainer operably connected to a second end of the utility tube.

29. The utility hub of claim 28, wherein the retainer includes a second collar the receives a second end of the utility tube.

30. The utility hub of claim 29, further including:

a plurality of connectors adapted to connected the utility tube to the post.

31. The utility hub of claim 30, wherein the central aperture includes a plurality of planar walls that cooperate to form a substantially octagon shape.

32. The utility hub of claim 23, wherein the housing insert includes an aperture in communication with the passage of the utility tube.

33. The utility hub of claim 23, wherein the housing insert includes a first collar that receives a first end of the utility tube therein.

34. The utility hub of claim 33, wherein the first collar extends upwardly from the housing insert.

35. The utility hub of claim 23, further including:

a retainer operably connected to a second end of the utility tube.

36. The utility hub of claim 35, wherein the retainer includes a second collar the receives a second end of the utility tube.

37. The utility hub of claim 23, further including:

a plurality of connectors adapted to connected the utility tube to the post.

38. The utility hub of claim 23, wherein the central aperture includes a plurality of planar walls that cooperate to form a substantially octagon shape.

* * * * *

UNITED STATES PATENT AND TRADEMARK OFFICE

CERTIFICATE OF CORRECTION

PATENT NO. : 6,553,730 B1
DATED : April 29, 2003
INVENTOR(S) : Karl H. Mueller et al.

It is certified that error appears in the above-identified patent and that said Letters Patent is hereby corrected as shown below:

Column 3,
Line 17, “includes” should be -- include --.
Line 44, “detachable” should be -- detachably --.

Column 4,
Line 6, “radially” should be -- radial --.
Line 32, “a” should be -- an --.
Line 33, “radially” should be -- radial --.

Column 5,
Line 27, before “utility” insert -- The --.

Column 6,
Line 26, before “32” insert -- narrowed neck portion --.
Line 27, before “operably” insert -- is --.
Line 36, “describe” should be -- described --.
Line 57, before “connected” insert -- are --.
Line 57, before “238” insert -- screws --.

Column 7,
Line 36, before “housing” insert -- the --.
Line 43, “space” should be -- spaced --.
Line 54, “inserting” should be -- insert --.
Line 66, before “housing” insert -- the --.

Column 8,
Line 17, “inserting” should be -- insert --.
Line 46, “22” should be -- 23 --.
Line 60, “the receives” should be -- that receives --.
Line 63, “connected” should be -- connect --.

UNITED STATES PATENT AND TRADEMARK OFFICE

CERTIFICATE OF CORRECTION

PATENT NO. : 6,553,730 B1
DATED : April 29, 2003
INVENTOR(S) : Karl H. Mueller et al.

It is certified that error appears in the above-identified patent and that said Letters Patent is hereby corrected as shown below:

Column 10,
Line 2, “the receives” should be -- that receives --.
Line 5, “connected” should be -- connect --.

Signed and Sealed this

Eighteenth Day of November, 2003

JAMES E. ROGAN
*Director of the United States Patent and Trademark Office*